US006536232B2

(12) United States Patent
Davidian et al.

(10) Patent No.: US 6,536,232 B2
(45) Date of Patent: Mar. 25, 2003

(54) METHOD FOR PLANT AND SEPARATING AIR BY CRYOGENIC DISTILLATION

(75) Inventors: Benoit Davidian, Saint-Maur des Fosses (FR); Francois De Bussy, Paris (FR)

(73) Assignee: L'Air Liquide, Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/955,261

(22) Filed: Sep. 19, 2001

(65) Prior Publication Data

US 2002/0053219 A1 May 9, 2002

(30) Foreign Application Priority Data

Sep. 19, 2000 (FR) ..... 00 11932

(51) Int. Cl.[7] ..... F25J 3/00
(52) U.S. Cl. ..... 62/643; 62/646
(58) Field of Search ..... 62/643, 646, 900

(56) References Cited

U.S. PATENT DOCUMENTS

| | | | | |
|---|---|---|---|---|
| 4,605,427 A | | 8/1986 | Erickson | |
| 5,341,646 A | * | 8/1994 | Agrawal et al. | 62/646 |
| 5,682,764 A | * | 11/1997 | Agrawal et al. | 62/646 |
| 5,881,570 A | * | 3/1999 | Drnevich et al. | 62/646 |
| 6,196,024 B1 | * | 3/2001 | Ha | 62/654 |
| 6,318,120 B1 | * | 11/2001 | Ha | 62/646 |
| 6,347,534 B1 | * | 2/2002 | Ha | 62/646 |

FOREIGN PATENT DOCUMENTS

| | | |
|---|---|---|
| EP | 0 687 876 A1 | 12/1995 |
| EP | 0 924 486 A2 | 6/1999 |

* cited by examiner

*Primary Examiner*—William C. Doerrler
(74) *Attorney, Agent, or Firm*—Young & Thompson

(57) ABSTRACT

In a plant for separating air which does not comprise an argon column, an intermediate-pressure column (102) has a bottom reboiler (24) which is heated by a gas (233) coming from the low-pressure column (103). The intermediate-pressure column is fed from the high-pressure column (101). This makes it possible to reduce the energy consumption while improving the efficiency of the process.

13 Claims, 4 Drawing Sheets

METHOD FOR PLANT AND SEPARATING AIR BY CRYOGENIC DISTILLATION

FIELD OF THE INVENTION

The present invention relates to a process and a plant for separating air by cryogenic distillation. In particular it relates to a process using three separation columns operating at a high pressure, a low pressure and a pressure which is intermediate between the high and low pressures.

BACKGROUND OF THE INVENTION

It is known from EP-A-0538118 to use a process of this type in order to separate air, the intermediate-pressure column having a bottom reboiler heated by nitrogen from the high-pressure column, thus reducing the heating of the bottom reboiler from the low-pressure column.

One aim of the invention is to reduce the energy consumption of the separation process with respect to the processes of the prior art.

Another aim of the invention is to produce oxygen with a purity of at least 95 mol %, or even at least 98 mol %, with an improved yield.

FIG. 1 shows a conventional process with a low-pressure column 103 operating at 1.3 bara enabling oxygen to be produced at 99.5 mol % with a yield of 92%.

A stream of 1 000 $Nm^3/h$ of air 1 at about 5 bara is divided into two in order to form a first stream 17 and a second stream 3 which is supercharged in a super-charger 5 at a higher pressure of about 75 bara.

The two streams 3, 17 are cooled on passing through a heat exchanger 100. The stream 17 is sent to the bottom of the high-pressure column 101 and the liquefied stream 3 in the heat exchanger 100 is expanded in a turbine 6 producing an at least partially liquid stream at its outlet, the fluid or mixture of fluids leaving the turbine 6 being sent at least in part to the high-pressure column 101.

A rich liquid stream 10 from the high-pressure column 101 is cooled in the subcooler 83 before being expanded and sent to an intermediate level of the low-pressure column 103.

A liquid airstream 12 is withdrawn from the high-pressure column 101, cooled in the subcooler 83, expanded and sent to the low-pressure column 103.

A waste nitrogen stream 72 is withdrawn from the top of the low-pressure column 103, sent to the subcooler 83 and then to the heat exchanger 100 where it is warmed.

A stream 31 of 193 $Nm^3/h$ of oxygen at 99.5 mol % is withdrawn in liquid form from the low-pressure column 103, pumped in the pump 19 to 40 bara and vaporized in the heat exchanger 100 in order to form a pressurized gas stream.

A stream of 200 $Nm^3/h$ of gaseous nitrogen 33 is withdrawn from the top of the high-pressure column 101 and is partially heated in the heat exchanger 100. At an intermediate temperature, part of the gas is expanded in a turbine 35 before being mixed with the waste gas 72.

In another conventional diagram illustrated in FIG. 2, the low-pressure column operates at 4.8 bara and the high-pressure column 101 operates at 14.3 bara. This process produces oxygen at 99.5 mol % with a yield of 78%.

A flow of 1 000 $Nm^3/h$ of air 1 at about 14.3 bara is divided into two in order to form a first stream 17 and a second stream 3 which is supercharged in a super-charger 5 to a higher pressure of about 75 bara.

The two streams 3, 17 are cooled on passing through a heat exchanger 100. The stream 17 is sent to the bottom of the high-pressure column 101 and the liquid stream 3 is expanded in a turbine 6 producing an at least partially liquid stream at its outlet, the fluid or mixture of fluids leaving the turbine 6 being sent at least in part to the high-pressure column 101.

A rich liquid stream 10 from the high-pressure column 101 is cooled in the subcooler 83 before being expanded and sent to an intermediate level of the low-pressure column 103.

A liquid airstream 12 is withdrawn from the high-pressure column 101, cooled in the subcooler 83, expanded and sent to the low-pressure column 103.

A waste nitrogen stream 72 is withdrawn from the top of the low-pressure column 103, sent to the subcooler 83 and then to the heat exchanger 100 where it is warmed.

A stream 31 of 164 $Nm^3/h$ of oxygen at 99.5 mol % is withdrawn in liquid form from the low-pressure column, pumped in the pump 19 to 40 bara and vaporized in the heat exchanger 100 in order to form a pressurized gas stream.

No gaseous nitrogen stream is withdrawn from the top of the high-pressure column 101 (of course a high-pressure gaseous nitrogen stream is condensed conventionally in a reboiler-condenser associated with the low-pressure column).

It is known from EP-A-833118 and U.S. Pat. No. 5,657,644 to heat an intermediate-pressure column of a triple-column system with an argon-enriched gas which also serves to feed an argon-production column.

SUMMARY OF THE INVENTION

The inventors of the present application have discovered that, even without using an argon-separation column, purification of the oxygen at the bottom of the low-pressure column remains satisfactory for the production of high-purity oxygen.

According to one object of the invention, provision is made for a process for separating air in a separation apparatus comprising a high-pressure column, an intermediate-pressure column having a bottom reboiler and a low-pressure column in which a) at least one mixture of at least oxygen, nitrogen and argon is sent at least to the high-pressure column where it is separated into a first oxygen-enriched stream and a first nitrogen-enriched stream, b) at least part of the first oxygen-enriched stream is sent to the column operating at intermediate pressure where it is separated into a second oxygen-enriched stream and a second nitrogen-enriched stream, c) at least part of the second oxygen-enriched stream and/or the second nitrogen-enriched stream is sent to the low-pressure column, d) a gas is sent from the lower part of the low-pressure column to the bottom reboiler of the intermediate-pressure column where it is condensed at least partially before being sent back to the low-pressure column, e) at least one oxygen-enriched fluid and at least one nitrogen-enriched fluid are withdrawn from the low-pressure column and f) at least part of the first nitrogen-enriched fluid is condensed at least partially in a reboiler-condenser associated with the low-pressure column and at least part of the at least partially condensed fluid is sent back to the high-pressure column characterized in that no fluid containing between 3 and 20 mol % argon is enriched with argon in a column of the apparatus other than the high-pressure, low-pressure and intermediate-pressure columns.

According to other optional objects of the invention, provision is made so that:

- the oxygen-enriched fluid withdrawn from the low-pressure column contains at least 95 mol % oxygen, possibly at least 98 mol % oxygen.
- no nitrogen-enriched gas stream is withdrawn from the top of the high-pressure column or a nitrogen-enriched gas stream is withdrawn from the top of the high-pressure column.
- the low-pressure column operates at at least 1.3 bara, optionally at least 2 bara, preferably at least 4 bara.
- one or more of the gaseous and/or liquid airstream(s) is (are) sent to the intermediate-pressure column and/or to the low-pressure column and/or to the high-pressure column.
- the gas coming from the lower part of the low-pressure column sent to the bottom reboiler contains between 1 and 20 mol % argon, preferably between 5 and 15 mol % argon, even more preferably between 8 and 10 mol % argon.
- at least part of the second nitrogen-enriched stream is condensed, optionally in a top condenser of the intermediate-pressure column.

According to another object of the invention, provision is made for a plant for separating air by cryogenic distillation comprising a high-pressure column, an intermediate-pressure column having a bottom reboiler and a low-pressure column, the high-pressure column and the low-pressure column being thermally coupled together, means for sending a mixture of at least oxygen, nitrogen and argon at least to the high-pressure column, means to send an oxygen-enriched stream from the high-pressure column to the intermediate-pressure column, means to send an oxygen-enriched fluid and/or a nitrogen-enriched fluid from the intermediate-pressure column to the low-pressure column, means to send a fluid from the low-pressure column to the bottom reboiler of the intermediate-pressure column, means to withdraw a nitrogen-enriched fluid and an oxygen-enriched fluid from the low-pressure column characterized in that it does not comprise means for the argon enrichment of a fluid containing between 3 and 20 mol % argon other than the high-pressure, low-pressure and intermediate-pressure columns.

According to other optional objects of the invention, the plant comprises:

- an expansion turbine and means to direct a stream from the low-pressure column to this turbine without compressing the stream.
- means to direct an airstream to the intermediate-pressure and/or low-pressure and/or high-pressure column.

Optionally, the fluid sent to the reboiler is withdrawn from the low-pressure column at a level lower than the level at which an oxygen-enriched fluid coming from the intermediate-pressure column is introduced.

Preferably, the intermediate-pressure column has a top condenser.

The so-called "oxygen-enriched" or "nitrogen-enriched" fluids are enriched with these components with respect to air.

Implementation examples of the invention will now be described with respect to FIGS. 3 and 4, which show schematic drawings of a plant according to the invention.

Figure 3:
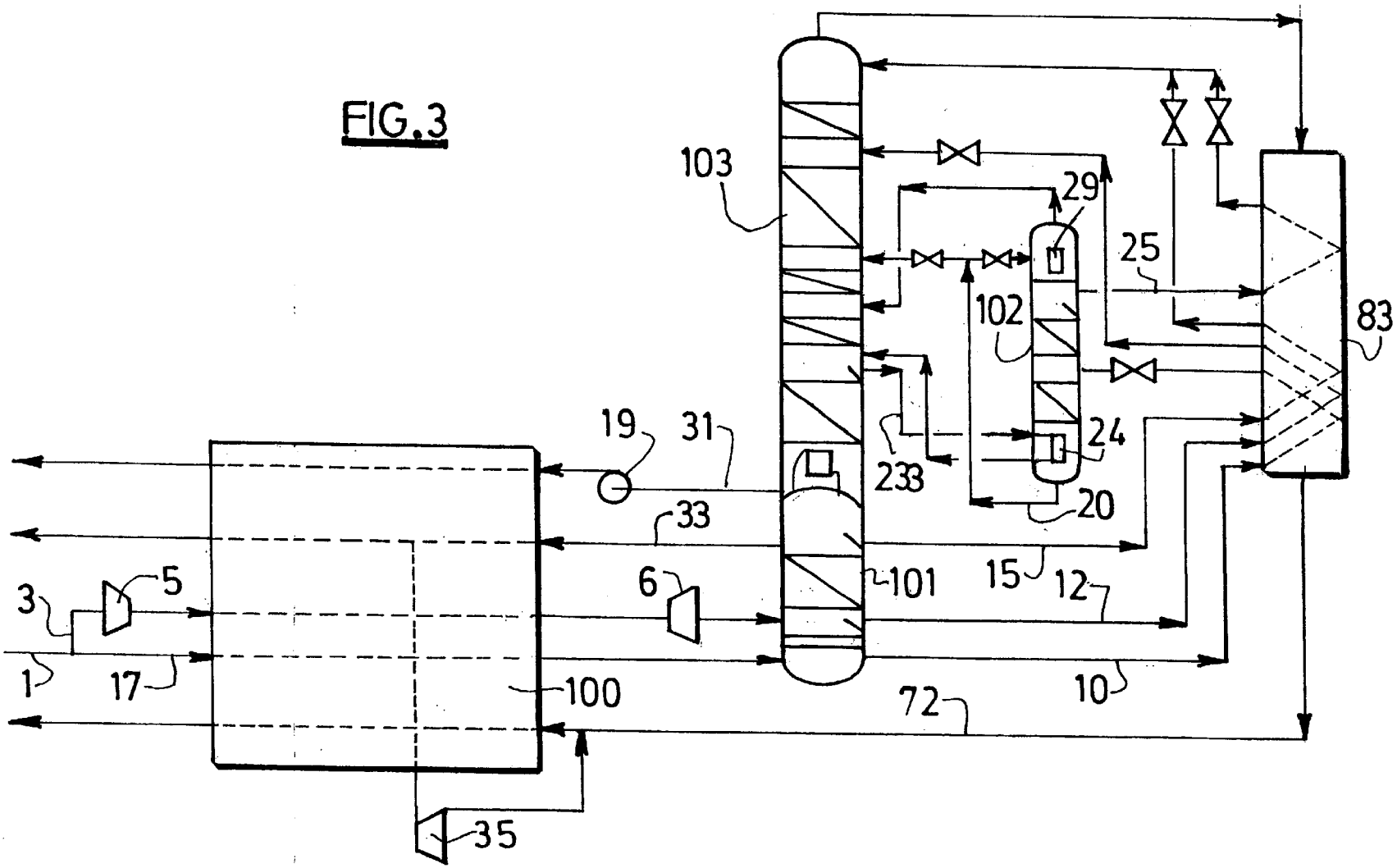
Figure 4:
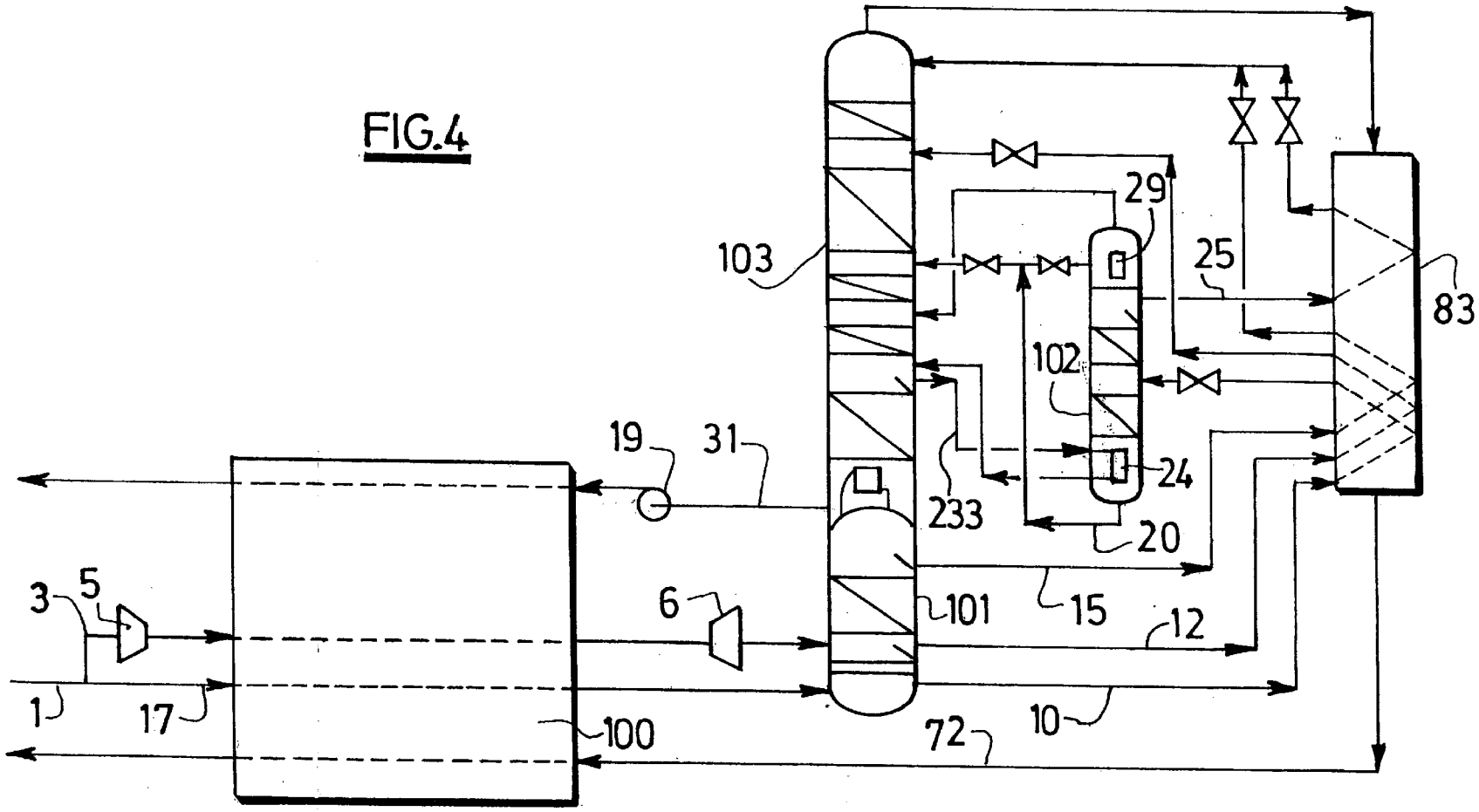

In FIG. 3, the apparatus operates with a low-pressure column at 1.3 bara and in FIG. 4, the apparatus operates with a low-pressure column at 4.8 bara.

DETAILED DESCRIPTION OF THE INVENTION

The plant of FIG. 3 comprises a high-pressure column 101 operating at 5 bara, an intermediate pressure column 102 operating at 2.7 bara and a low-pressure column 103 operating at 1.3 bara. Part of the gaseous nitrogen from the top of the high-pressure column serves to heat the bottom reboiler of the low-pressure column but other heating means can be envisaged, such as double reboiler systems, one of which is heated by air.

A stream of 1 000 $Nm^3/h$ of air 1 at about 5 bara is divided into two in order to form a first stream 17 and a second stream 3 which is supercharged in a super-charger 5 to a higher pressure of about 75 bara.

The two streams 3, 17 are cooled on passing through a heat exchanger 100. The stream 17 is sent to the bottom of the high-pressure column 101 without having been expanded or compressed and the liquid stream 3 is expanded in a turbine 6 producing an at least partially liquid stream at its outlet, the fluid or mixture of fluids leaving the turbine 6 being sent at least in part to the high-pressure column 101.

A rich liquid stream 10 from the high-pressure column 101 is cooled in the subcooler 83 before being expanded and sent to an intermediate level of the intermediate-pressure column 102 between two sections, for example of structured packings of the crossed-corrugated type. The liquid can be sent to another level of the column and the column can also receive a gaseous air or liquid stream.

This liquid is separated into a second oxygen-enriched liquid 20 and a nitrogen-enriched liquid 25. The liquid 25 is cooled in the subcooler 83, before being expanded and sent to the top of the low-pressure column 103, after being mixed with a stream of lean liquid 15 from the top of the high-pressure column 101 which has also been cooled in the subcooler 83 and expanded in a valve.

The liquid 20 from the bottom of the intermediate-pressure column is divided into two. Part is expanded and sent directly to the low-pressure column while the rest is expanded in a valve, sent to the top condenser 29 of the intermediate-pressure column where it is vaporized at least partially before being sent to the low-pressure column 103.

A liquid airstream 12 is withdrawn from the high-pressure column, cooled in the subcooler 83, expanded and sent to the low-pressure column 103.

The reboiler 24 at the bottom of the intermediate-pressure column 102 is heated by means of an argon-enriched gas stream 233 containing about 5 to 15 mol %, preferably between 8 and 10 mol %, argon from the low-pressure column 103. This stream is condensed at least partially in the reboiler 24 before being sent back to the low-pressure column 103.

A waste nitrogen stream 72 is withdrawn from the top of the low-pressure column 103, sent to the subcooler 83 and then to the heater exchanger 100 where it is warmed.

A stream 31 of 203 $Nm^3/h$ oxygen at 99.5 mol % is withdrawn in liquid form from the low-pressure column 103, pumped in the pump 19 to 40 bara and vaporized in the heat exchanger 100 in order to form a pressurized gas stream.

A stream 33 of 200 $Nm^3/h$ of gaseous nitrogen is withdrawn at the top of the high-pressure column 101 and is partially heated in the heat exchanger 100. At an intermediate temperature, part of the gas is expanded in a turbine 35 before being mixed with the waste gas 72. The rest of the nitrogen continues its reheating and is a product of the apparatus.

It is possible to withdraw liquid products from the apparatus but the apparatus does not produce any argon-rich fluid.

The plant of FIG. 4 comprises a high-pressure column 101 operating at 14.3 bara, an intermediate-pressure column 102 operating at 8.5 bara and a low-pressure column 103 operating at 4.8 bara. All the gaseous nitrogen from the top of the high-pressure column serves to heat the bottom reboiler of the low-pressure column but other heating means can be envisaged, such as systems with double reboilers, one of which is heated by air.

A stream of 1 000 $Nm^3/h$ of air 1 at about 14.3 bara is divided into two in order to form a first stream 17 and a second stream 3 which is supercharged in a super-charger 5 to a higher pressure of about 75 bara.

The two streams 3, 17 are cooled on passing through a heat exchanger 100. The stream 17 is sent to the bottom of the high-pressure column 101 and the liquid stream 3 is expanded in a turbine producing an at least partially liquid stream at its outlet, the fluid or mixture of fluids leaving the turbine being sent at least in part to the high-pressure column 101.

A rich liquid stream 10 from the high-pressure column 101 is cooled in the subcooler 83 before being expanded and sent to an intermediate level of the intermediate-pressure column 102 between two sections, for example of structured packings of the cross-corrugated type. The liquid can be sent to another level of the column and the column may also receive a stream of gaseous or liquid air.

This liquid is separated into a second oxygen-enriched liquid 20 and a nitrogen-enriched liquid 25. The liquid 25 is cooled in the subcooler 83, before being expanded and sent to the top of the low-pressure column 103, after being mixed with a lean liquid stream 15 from the top of the high-pressure column 101 which has also been cooled in the subcooler 83 and expanded in a valve.

The liquid 20 from the bottom of the intermediate-pressure column is divided into two. Part is expandeed and sent directly to the low-pressure column while the rest is expanded in a valve, sent to the top condenser 29 of the intermediate-pressure column where it is vaporized at least partially before being sent to the low-pressure column 103.

A liquid air flow 12 is withdrawn from the high-pressure column, cooled in the subcooler 83, expanded and sent to the low-pressure column.

The bottom reboiler 24 of the intermediate-pressure column 102 is heated by means of an argon-enriched gas stream 233 containing about 5 to 15 mol %, preferably 8 to 10 mol %, argon coming from the low-pressure column 103. This stream is condensed at least partially in the reboiler 24 before being sent back to the low-pressure column 103.

A waste nitrogen stream 72 is withdrawn from the top of the low-pressure column 103, sent to the subcooler 83 and then to the heat exchanger 100 where it is warmed.

A stream 31 of 177 $Nm^3/h$ oxygen at 99.5 mol % is withdrawn in liquid form from the low-pressure column, pumped in the pump 19 to 40 bara and vaporized in the heat exchanger 100 in order to form a pressurized gas stream.

It is possible to withdraw liquid products from the apparatus but the apparatus does not produce any argon-enriched fluid.

The advantages of the invention will appear clearly on studying the table below.

Other alternative or additional refrigerating means can be envisaged, such as an air-blowing turbine, a Claude turbine or another turbine which is not fed by a liquid stream or a gas turbine from the low-pressure column.

The apparatus may receive all or part of its feed air from a compressor of a gas turbine, the waste nitrogen from the apparatus being sent back to the gas turbine.

Figure 1:
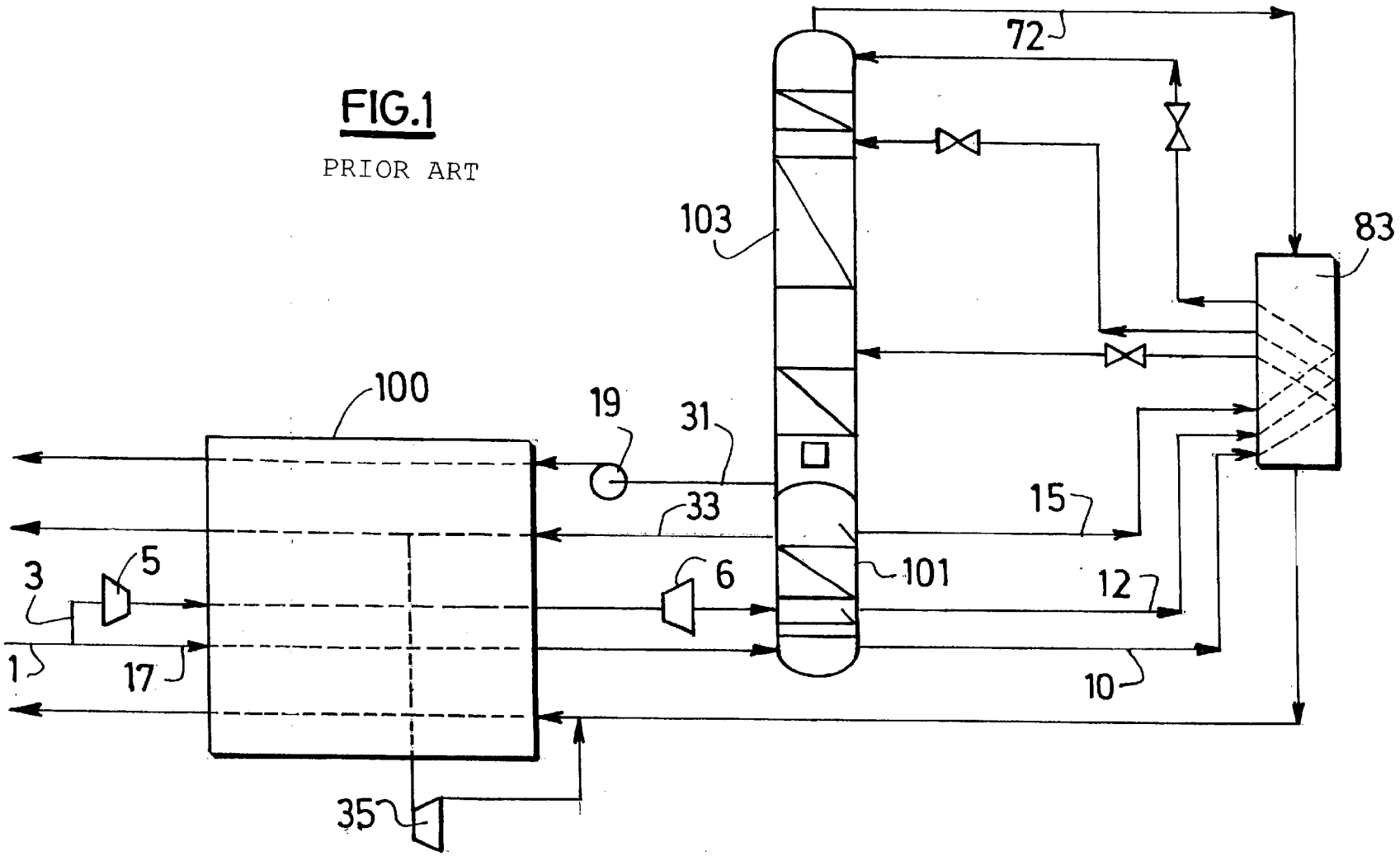
FIG.1 PRIOR ART
FIGS. 1 and 2 show prior art systems.

| | Process of FIG. 1 | Process of FIG. 3 (invention) |
|---|---|---|
| Pressure of the high-pressure column | 5 bara | 5 bara |
| Pressure of the low-pressure column | 1.3 bara | 1.3 bara |
| Pressure of the intermediate-pressure column | | 2.7 bara |
| Total airstream treated | 1 000 $Nm^3/h$ | 1 000 $Nm^3/h$ |
| Oxygen content of the gaseous product | 99.5% $O_2$ | 99.5% $O_2$ |
| Oxygen production considered pure | 193 $Nm^3/h$ | 203 $Nm^3/h$ |
| High-pressure gaseous nitrogen production | 200 $Nm^3/h$ | 200 $Nm^3/h$ |
| Efficiency of extraction of oxygen | 92% | 97% |
| Separation energy | Base: 100 | 95 |

Figure 2:
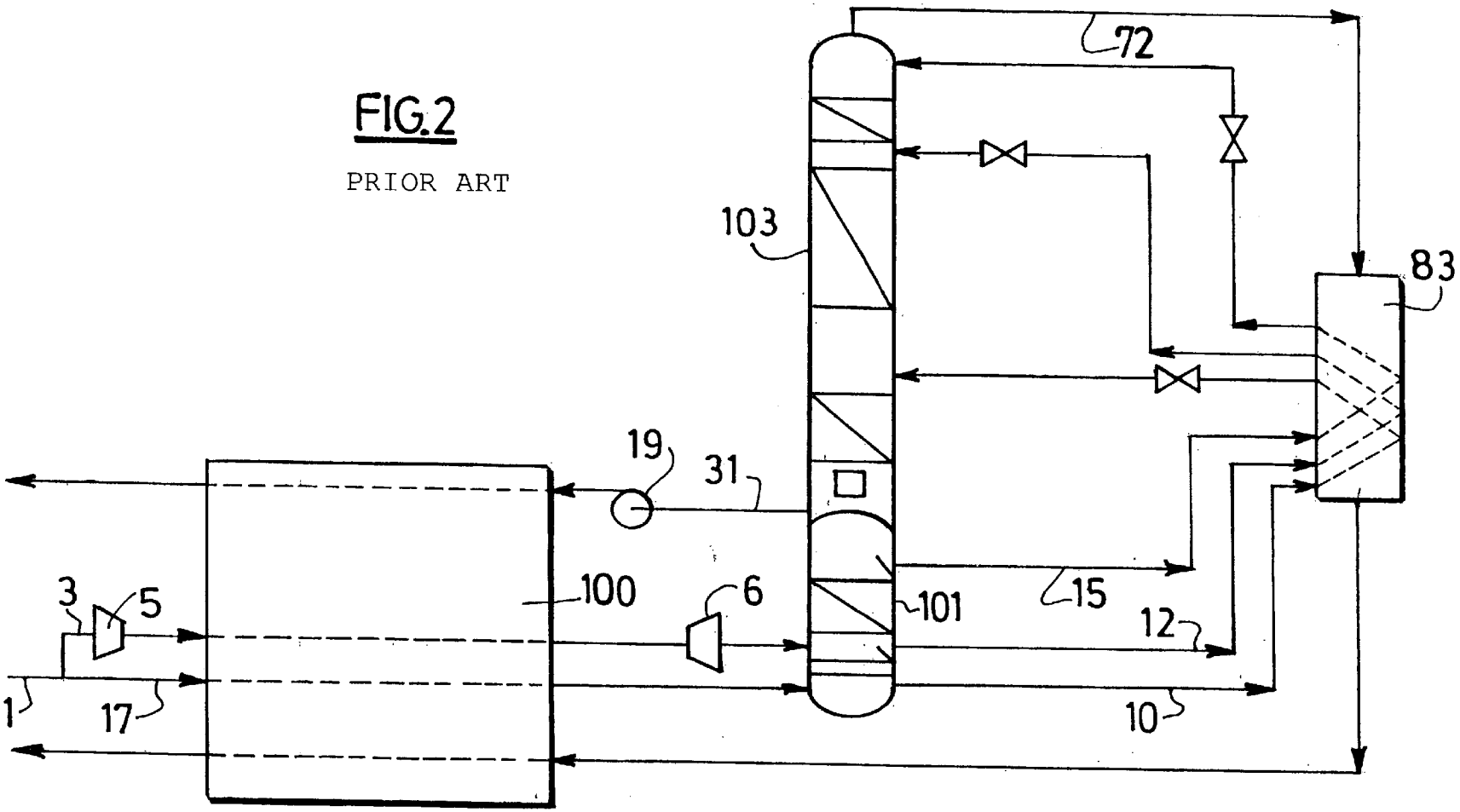
FIG.2 PRIOR ART

| | Process of FIG. 2 | Process of FIG. 4 (invention) |
|---|---|---|
| Pressure of the high-pressure column | 14.3 bara | 14.3 bara |
| Pressure of the low-pressure column | 4.8 bara | 4.8 bara |
| Pressure of the intermediate-pressure column | | 8.5 bara |
| Total airstream | 1 000 $Nm^3/h$ | 1 000 $Nm^3/h$ |
| Oxygen content of the gaseous product | 99.5% $O_2$ | 99.5% $O_2$ |
| Oxygen production considered pure | 164 $Nm^3/h$ | 177 $Nm^3/h$ |
| High-pressure gaseous nitrogen production | 0 $Nm^3/h$ | 0 $Nm^3/h$ |
| Efficiency of extraction of oxygen | 78% | 85% |
| Separation energy | Base: 100 | 90 |

What is claimed is:

1. Process for separating air in a separation apparatus comprising a high-pressure column (101), an intermediate-pressure column (102) having a bottom reboiler (24) and a low-pressure column (103) in which a) at least one mixture (1) of at least oxygen, nitrogen and argon is sent at least to the high-pressure column where it is separated into a first oxygen-enriched stream and a first nitrogen-enriched fluid, b) at least part of the first oxygen-enriched stream (10) is sent to the column operating at intermediate pressure where it is separated into a second oxygen-enriched stream (20) and a second nitrogen-enriched stream (25), c) at least part of the second oxygen-enriched stream and/or the second nitrogen-enriched stream is sent to the low-pressure column, d) a gas (233) is sent from the lower part of the low-pressure column to the bottom reboiler of the intermediate-pressure column where it is condensed at least partially before being sent back to the low-pressure column, e) at least one oxygen-enriched fluid (31) and at least one nitrogen-enriched fluid (72) are withdrawn from the low-pressure column and f) at least part of the first nitrogen-enriched fluid is condensed at least partially in a reboiler-condenser associated with the low-pressure column and at least part of the at least partially condensed fluid is sent back to the high-pressure column characterized in that no fluid containing between 3 and 20 mol% argon is enriched with argon in a column of the apparatus other than the high-pressure, low-pressure and intermediate-pressure columns.

2. Process according to claim 1 in which the oxygen-enriched fluid (31) withdrawn from the low-pressure column contains at least 95 mol% oxygen, possibly at least 98 mol% oxygen.

3. Process according to claim 1 in which a nitrogen-enriched gas stream is withdrawn from the top of the high-pressure column (101).

4. Process according to claim 1, in which a nitrogen-enriched gas stream (33) is withdrawn from the top of the high-pressure colum (101).

5. Process according to claim 1, in which the low-pressure column (103) operates at at least 1.3 bara.

6. Process acroding to claim 1 in which one or more of the gaseous and/or liquid airstream is sent to one of the intermediate-pressure colum and the low-pressure column.

7. Process according to claim 1 in which the gas (233) coming from the lower part of the low-pressure column sent to the bottom reboiler contains between 1 and 20 mol % argon.

8. Process according to claim 1 in which at least part of the second nitrogen-enriched stream is condensed, optionally in a top condenser (22) of the intermediate-pressure column.

9. Plant for separating air by cryogenic distillation comprising a high-pressure column (101), an intermediate-pressure column (102) having a bottom reboiler (24) and a low-pressure column (103), the high-pressure column and the low-pressure column being thermally connected together, means for sending a mixture (1) of at least oxygen, nitrogen and argon at least to the high-pressure column, means to send an oxygen-enriched stream (10) from the high-pressure column to the intermediate-pressure column, means to send an oxygen-enriched fluid (20) and/or a nitrogen-enriched fluid (25) from the intermediate-pressure column to the low-pressure column, means to send a fluid (233) from the low-pressure column to the bottom reboiler of the intermediate-pressure column, means to withdraw a nitrogen-enriched fluid (72) and an oxygen-enriched fluid (31) from the low-pressure column characterized in that it does not comprise means for the argon enrichment of a fluid containing between 3 and 20 mol % argon other than the high-pressure, low-pressure and intermediate-pressure columns.

10. Plant according to claim 9 comprising an expansion turbine and means to direct a stream from the low-pressure column to this turbine without compressing the stream.

11. Plant according to claim 9 comprising means to direct an airstream to the intermediate-pressure and/or low-pressure and/or high-pressure column (101, 102, 103).

12. Plant according to claim 9 in which the fluid (233) sent to the reboiler is withdrawn from the low-pressure column at a level lower than the level at which an oxygen-enriched fluid coming from the intermediate-pressure column is introduced.

13. Plant according to claim 9 in which the intermediate-pressure column (102) has a top condenser (22).

* * * * *